United States Patent [19]

Hershyn

[11] Patent Number: 4,870,671

[45] Date of Patent: Sep. 26, 1989

[54] MULTITARGET X-RAY TUBE

[75] Inventor: William Hershyn, Felton, Calif.

[73] Assignee: X-Ray Technologies, Inc., Santa Cruz, Calif.

[21] Appl. No.: 263,069

[22] Filed: Oct. 25, 1988

[51] Int. Cl.[4] ..... H01J 35/08

[52] U.S. Cl. ..... 378/124; 378/134

[58] Field of Search ..... 378/124, 134, 140

[56] References Cited

U.S. PATENT DOCUMENTS

| | | | |
|---|---|---|---|
| 4,007,375 | 2/1977 | Albert | 378/124 |
| 4,017,757 | 4/1977 | DeCou, Jr. | 378/124 |
| 4,292,563 | 9/1981 | Gabbay et al. | 378/124 |

FOREIGN PATENT DOCUMENTS

| | | | |
|---|---|---|---|
| 2133208 | 7/1984 | United Kingdom | 378/124 |

OTHER PUBLICATIONS

Varian Eimac Product Data brochure on a DTS-68H X-Ray Tube from the identified employer of the authors of Reference AR, Machlett Laboratories, designated ST-4301, dated 1/89.

Abstract of "System Design Principles for Long X-Ray Tube Life for a New Dual Target End Window XRF Tube", presented by Barrett et al of Machlett Laboratories at the Pittsburgh Conference of Analytical Chemistry and Applied Spectroscopy, Feb. 22-26, 1988, New Orleans, LA.

Link Analytical Limited Brochure XR 200/300/5/87/10M.

*Primary Examiner*—Craig E. Church

*Attorney, Agent, or Firm*—Cooper & Dunham

[57] ABSTRACT

A multitarget x-ray tube which generates a number of x-ray beams of different characteristics in any desired combinations and/or sequences and in which cross-talk is reduced and beam purity is enhanced. The tube can be used in applications such as elemental analysis of materials by x-ray fluorescence, in which a sample is excited with x-rays from a primary source and in response releases x-ray photons having energies characteristic of the elements present in the sample, and in applications in which it can replace a radioactive source.

27 Claims, 3 Drawing Sheets

MULTITARGET X-RAY TUBE

BACKGROUND AND SUMMARY OF THE INVENTION

The invention is in the field of x-ray tubes and particularly x-ray tubes used in industrial applications. Such tubes are available, for example, from X-Ray Technologies, Inc., Santa Cruz, Calif., and can be used in applications such as elemental analysis of materials by x-ray fluorescence. In such analysis a sample is excited with x-rays from a primary source and in response releases x-ray photons having energies characteristic of the elements present in the sample. The released photons are detected and their spectrum is displayed and/or used to deduce the elemental composition of the sample. Exemplary systems of this type are the XR 200/300 energy dispersive x-ray fluorescence spectrometers made by the U.K. company Link Analytical Limited and described in the company's brochure XR200/300/5/87/10M which is hereby incorporated in this disclosure by reference.

Typically, such x-ray tubes have a single x-ray target which is bombarded with electrons and generates x-rays leaving the tube housing through a side window or an end window. The x-ray characteristics are determined by factors such as the target material and geometry, the x-ray take-off angle (the angle of the utilized x-ray beam relative to the plane of the target), the nature and geometry of the electron source and the voltage difference between the electron source and the target. In addition, it is believed that some manufacturers have made x-ray tubes with several targets but a single electron source and either a single window or several windows, for x-rays which have respective take-off angles and different x-ray properties. Still in addition, it is believed that samples of x-ray tubes with twin, coplanar targets from different materials (iron and molybdenum), with a respective individually wired filament for each target but a single side window for the beams from the two targets, were sold in this country more than a year before the filing date of this application, for use in feasibility studies. Still in addition, it is believed that dual target tubes may have been sold in this country by Ortec, a company in Oak Ridge, Tenn., and that twin target x-ray tubes may have been discussed in a paper entitled "System Design Principles for Long X-Ray Tube Life for a New Dual Target End Window XRF Tube" presented as paper No. 633 by R. Barrett of The Machlett Laboratories, Inc. at The Pittsburgh Conference & Exposition On Analytical Chemistry and Applied Spectroscopy held Feb. 22–26, 1988 in New Orleans. La. Still in addition, it is believed that an x-ray tube was sold in this country and used to study jet exhausts more than a year before the filing date of this application, had a conical target of a single target material and generated x-rays in response to a cylindrical electron beam coaxial with the conical target, with the x-rays taken out through an annular window coplanar with a section of the cone normal to the cone axis. A twin or quadruple target x-ray tube using a single end window and individual filaments for the targets, is proposed in Machlett U.S. Pat. No. 4,017,757. No internal collimation separating the x-rays from the individual targets, and no use of separate windows, appear to be taught in that patent.

While these and similar prior art proposals can be useful in generating x-rays suitable for a desired purpose, it is believed that a need still remains for an x-ray tube which can generate purer and better controlled x-ray beams at higher efficiency, with reduced cross-talk between the different electron and x-ray beams, and with tube geometry allowing close coupling and convenient and effective collimation. This invention is directed to meeting such needs.

An x-ray tube in accordance with an example of the invention comprises a multifaceted anode with targets which are in different planes and are made of different materials. Each target has its individually controlled electron source, allowing the targets to be turned on and off in any desired pattern and/or sequence. The x-rays from the different targets are taken out at a high efficiency angle and through respective internal collimators and respective individual end windows. To suppress cross-talk between the different electron and x-ray beams and enhance the purity of the x-ray beams, the invented structure provides a particularly effective geometry of separate electron guns, non-coplanar and well separated targets, good control over electric fields, and separate internal collimators and windows and close coupling to the ultimate targets of the respective x-ray beams. Substantially the entire target can emit x-rays or, alternatively, one or more of the electron beams can be shaped such that their targets emit x-rays only or primarily from a focal spot which is smaller than the entire target area.

In a particular exemplary and nonlimiting embodiment of the invention, the x-ray tube has a target support which has a multifaceted, e.g., generally pyramidal front end. In order to reduce cross-talk through effective control over the electron beams and effective separation between the targets, the generally pyramidal front end has channels where its ridges would normally be and has a central axial bore instead of a forwardly projecting tip. Each facet has thereon an x-ray target which is made of a different material and therefore emits different x-rays when energized by its own electron gun. The target material may extend into the channels and the axial bore but the targets remain spaced from each other. In order to further reduce cross-talk and enhance the purity of the x-ray beams, the outer edges of the channels and the axial depression are rounded. The x-ray tube housing has a respective separate, end window for an x-ray beam from each of said targets. Internal collimation separates the x-ray beams from the respective targets to further reduce cross-talk and enhance beam purity. The respective x-ray beams can be parallel to each other and to the axis of the target holder or can be directed along respective different beam axes. The x-ray tube can be used in equipment having a network for individually controlling the electron guns to generate a selected pattern and/or sequence of said individual x-ray beams. When the x-ray tube is used for elemental analysis of materials, the equipment can select only the x-ray beam appropriate for the material being analyzed, or can sequentially use all or some subset of the available x-ray beams or can use a pattern of all or a subset of the beams or a sequence of patterns of subsets, all without changing the x-ray tube or the KV. Other desirable effects can be obtained by varying the tube KV and/or the cathode current as well.

An alternate embodiment also has a number of targets but they are substantially coplanar and are excited with electron beams which are substantially perpendicular to the plane of the targets. The targets emit x-rays in the directions of the electron beams. This embodiment is believed to be particularly useful as a replacement for radioactive sources which is easier to control and more versatile.

DETAILED DESCRIPTION

Figure 1:
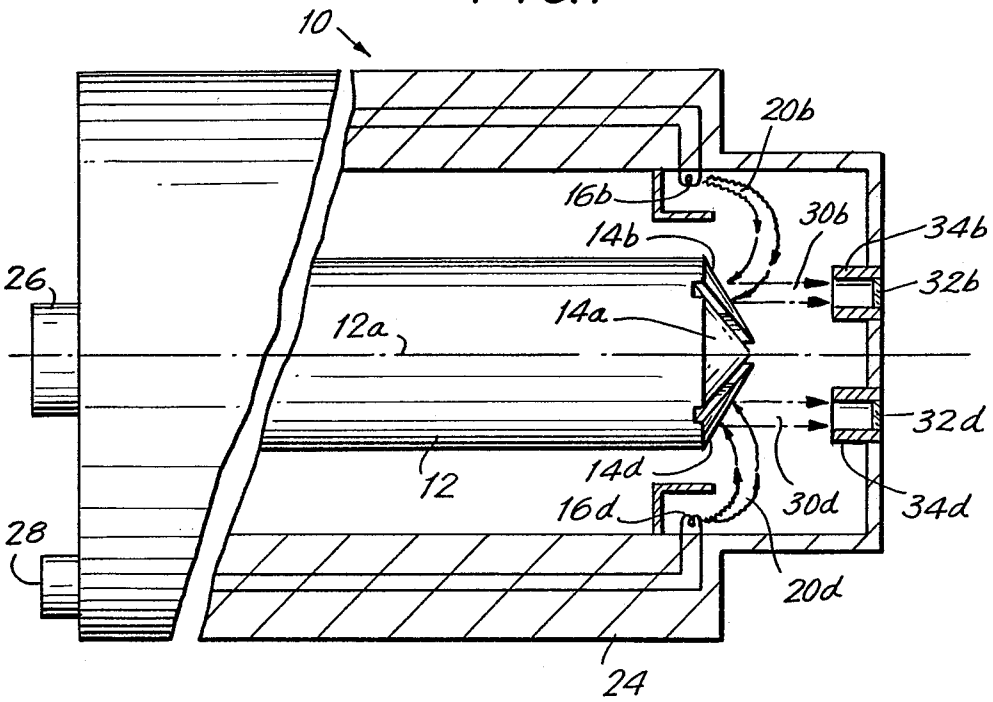
FIG. 1 is a side elevation, partly cut-away, of an x-ray tube embodying one example of the invention.
Figure 2:
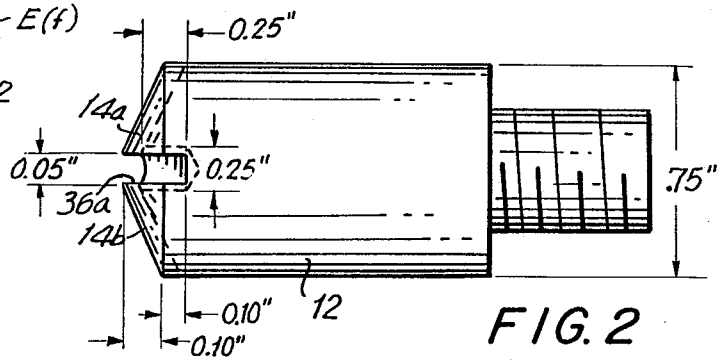
FIG. 2 is a side elevation of a multifaceted x-ray target support used in the embodiment of FIG. 1.
Figure 3:
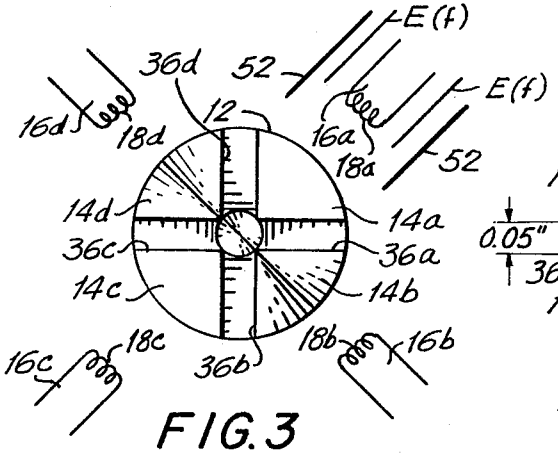
FIG. 3 is a front elevation of the multifaceted target support and further illustrates electron guns for energizing the targets.
Figure 5:
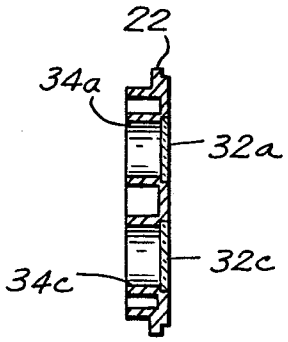
FIG. 5 is a section at line 5—5 in FIG. 4.
Figure 4:
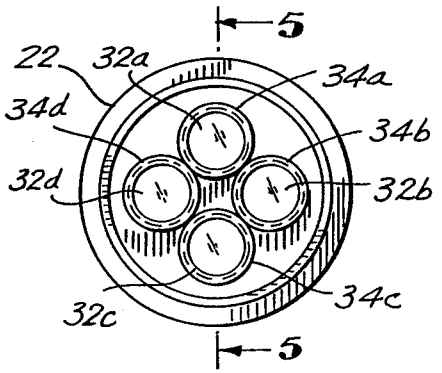
FIG. 4 is a front elevation of end windows used in the embodiment of FIG. 1.
Figure 6:
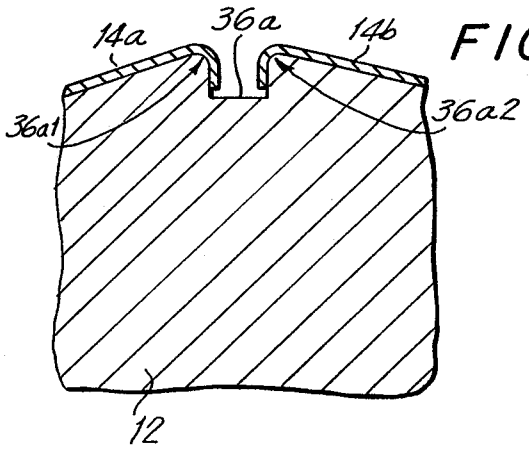
FIG. 6 is a section through two adjacent targets, taken in a plane parallel to the target holder axis.

FIGS. 1–6 illustrate an exemplary embodiment of a multitarget x-ray tube 10 in accordance with the invention. Tube 10 generates four parallel, well collimated x-ray beams which have different characteristics and exhibit little cross-talk. The four x-ray beams can be turned on and off in any desired sequence or pattern. X-ray tube 10 comprises a round target support 12 which has a multifaceted front end with a number of targets **14*a*–14*d* thereon. In this example the front end of target support 12 is generally pyramidal in shape, but the bases of the generally triangular sides of the pyramid are curved, the tip of the pyramid is replaced by an axial bore and the pyramid has channels separating its sides. Target support 12 is made of a material such as copper which is a good thermal and electrical conductor. Each of targets 14*a*–14*d* has a differently oriented x-ray emitting surface and can be made of a different x-ray emitting material. In this example, the four targets 14*a*–14*d* are made of titanium, palladium, platinum and copper, respectively. Each of targets 14*a*–14*d* has a respective, individually controlled electron source, in the form of an electron gun 16*a*–16*d*, and each gun has a respective filament 18*a*–18*d*. Each of guns 16*a*–16*d* when energized emits a respective electron beam 20*a*–20*d* which, due to the potential difference between the gun and target and the tube geometry, impinges on the respective one of targets 14*a*–14*d* to cause x-ray emission therefrom. A front housing 22 encloses the front end of target support 12 and electron guns 14*a*–14*d*, and is connected to a main, larger housing 24 which in a known manner mechanically supports the previously described components and serves as a heat sink (and can have a non-circulating or a circulating oil bath) and has HV connectors 26 and filament connectors 2 at its back end. HV connectors 26 supply high voltage to target support 12 (and hence to targets 14*a*–14*d*) and to each of electron guns 14*a*–14*d* to establish in a known manner a potential difference between each gun and its target which is sufficient to generate the respective electron beams 2*a* –20*d* when the respective filaments 18*a*–18*d* are energized. Filament connectors 28 provide operating current to filaments 18*a*–18*d*. It is important to note that there are separate, individually controlled connections to the respective filaments so that any one or more filaments can be on or off at any one time. When energized by their respective electron beams 20*a*–20*d*, targets 14*a*–14*d* emit respective x-ray beams 30*a*–30*d* which are taken out through respective end windows 32*a*–32*d* in front housing 22. Cross-talk is reduced by providing tubular internal collimators 34*a*–34*d* through which the respective x-ray beams 30*a*–30*d* pass on their way to the respective end windows 32*a*–32*d*. In this example the geometry of the targets, the collimators and the windows is such that x-ray beams 30*a*–30*d* are substantially parallel to each other and to axis 12*a* of target support 12. The sides of the pyramid at the front end of target support 12 are separated from each other by channels 36*a*–36*d* and the pyramid has an axial depression or bore 38 at its front end which is deeper than said channel. Targets 14*a*–14*d* cover the facets of the front end of the pyramid and each target extends partway into two adjacent ones of channels 36*a*–36*d* and into axial bore 38 but the targets remain spaced from each other. As illustrated in FIG. 6, each of the x-ray targets can be a thin plate secured to the respective side of the pyramidal front end of target holder 12, for example by brazing. Note that each target is bent over to extend partway into each adjacent channel, for example to (or close to) the bottom of the channel, and that the outside edges of each channel are rounded, as illustrated at 36*a*1 and 36*a*2 for channel 36*a*. Note also that the outside edge of axial bore 38 is similarly rounded, as are the corners where the outside edges of the bore and the channels meet, and that the outside edge of bore 38 is not continuous but is made of the arcs which are between converging outside edges of adjacent channels. The dimensions of an exemplary embodiment of the target support and its faces, channels and bore are shown in FIGS. 2–4, e.g., target support 12 is round and has a diameter of about 0.75", the axial extent of its front end is about 0.10", the channels are about 0.10" deep and about 0.05 wide, the axial depression is about 0.25" deep and about 0.25" in diameter. The target material extends about 0.10" or slightly less into the channels and the axial bore. Note that the thickness of targets 14*a* and 14*b* is exaggerated in FIG. 6. In fact, the target thickness is of the order of 10 mils and there is a minimum required thickness, which is about 2 mils for typical target materials. If the target is of the same material as target support 12**, a target plate may be brazed on or the appropriate facet of the target support front end may be appropriately finished so that its surface would serve as a target. The following materials are believed suitable for use as targets: Ti, Cr, Fe, Co, Ni, Cu, Mo, Rh, Ag, Ta, W, Re, Pt and Au. Which materials are selected for a particular x-ray tube and in what order they are arranged on the facets of the target support, depends primarily on the intended use of the x-ray tube.

Figure 7:
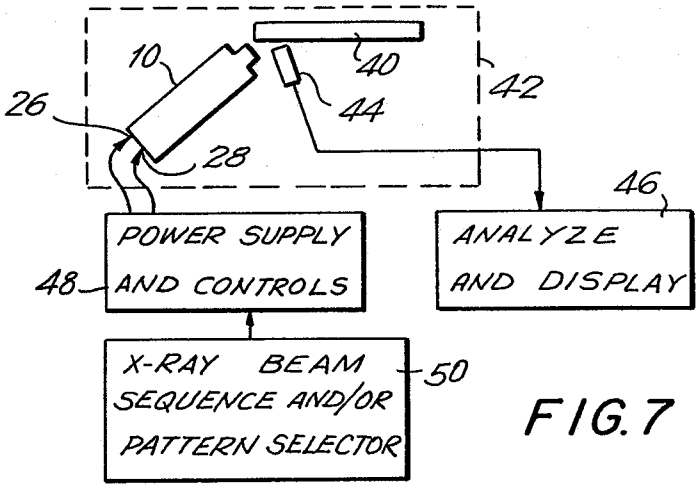
FIG. 7 is a block diagram of an x-ray fluorescence spectrometer using an x-ray tube made in accordance with the invention.

An x-ray tube made in accordance with the invention can be used, for example in an x-ray fluorescence spectrometer such as the earlier-identified units made by Link Analytical, to replace an x-ray tube of the type currently used therein. Referring to FIG. 7, which illustrates pertinent components of such a spectrometer in schematic form, x-ray tube 10 of the type discussed in connection with FIGS. 1–6, is oriented such that its x-ray beams **30*a*–30*d* impinge on a sample of material under analysis which is on a rotatable sample tray 40 in a housing 42. The x-rays emitted from the sample in response to the impingement thereon of x-rays from tube 10 are detected at a detector 44 whose output is analyzed and the results are displayed at an analyzer and display unit 46. Power is supplied to x-ray tube 10 from a power supply and control unit 48 through HV connectors 26 and filament connectors 28 in a manner which allows the on and off state of each of x-ray beams 30***a*–30*d* to be individually controlled. A unit 50, designated x-ray beam sequence and/or pattern selector, can operate under manual control, such as a selector knob or a keyboard, to provide unit 48 with control signals determining which of x-ray beams 30*a*–30*d* will be on and which will be off at any particular time. Alternately, these control signals can be generated as a programmed sequence under the control of the computer which is typically included in an analyzer of the kind identified above.

In operation, a sample is brought in position by suitably rotating sample tray 40 and x-ray tube 10 is energized under the control of units 48 and 50 to generate a selected pattern and/or sequence of x-ray beams of different characteristics from its different targets. The collimated x-ray beams 30*a*–30*d* impinge on the target sample, which in response generates x-rays which have characteristics which depend in part on the nature of the impinging x-rays and in part on the nature of the sample material. The x-rays emitted from the sample are analyzed in a known manner and the results can be displayed or otherwise utilized in a known manner. The four x-ray beams from tube 10 can be all on at the same time, or can be turned on one at a time in any desired sequence, or can be turned on in any desired pattern of less than all four beams, or in any desired sequence of patterns or of patterns and single beams. The four x-ray beams can be parallel to each other and to the target support axis, as described above, or the geometry can be changed appropriately such that the four beams are at an angle to each other and/or the target support axis, for example such that they converge at the sample being analyzed.

Figure 8B:
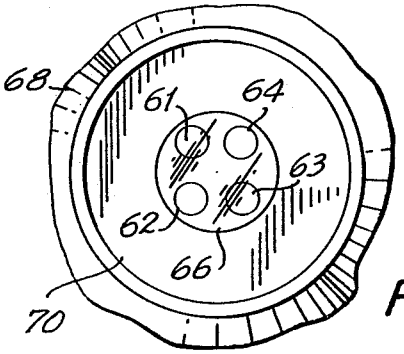
FIG. 8*a* is a partial section of the front end of an x-ray tube illustrating an alternate embodiment and FIG. 8*b* is a front elevation of the tube of FIG. 8*a*.
Figure 8A:
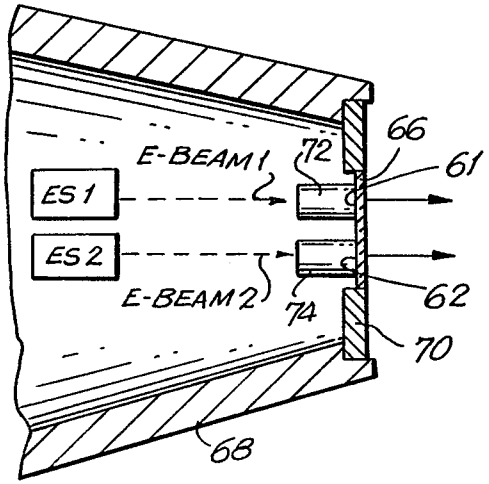

An alternate embodiment of the invention, illustrated in FIGS. 8*a* and 8*b*, is particularly suitable for replacing radioactive material radiation sources in some applications. In this embodiment x-ray targets 61–64 are at the inside surface of x-ray window 66, facing the inside of a suitable vacuum housing 68. Window 66 is supported at the center of a target support 70 which in turn is affixed to the front end of housing 68. Targets 61–64 can but need not be made of different materials and can be formed on the inside surface of window 66 by a process such as sputtering. There is a separate, individually controlled electron source for each of targets 61–64 (only sources ESI and ES2, for targets 61 and 62 are visible in FIG. 8*a*). Each source emits a respective electron beam which travels to its respective target along a direction substantially perpendicular to the plane of the target, as illustrated in FIG. 8*a* for the electron beams to targets 61 and 62. Each electron beam causes its target to emit an x-ray flux which exits housing 68 by passing through the outside surface of window 66 in a direction generally following the direction of the impinging electron beam, as is illustrated in FIG. 8*a* for the x-rays from targets 61 and 62. In order to reduce cross-talk, the tube includes a respective collimator for each target. As illustrated in FIG. 8*a* for collimators 72 and 74, for targets 61 and 62 respectively, each collimator is tubular, surrounds its target and extends therefrom toward the interior of housing 68. If desired, external collimators can be provided as well which can be in the form of tubes of x-ray attenuating material which surround the respective projection of the targets on the outside surface of window 66 and extend away from housing 68, to reduce cross talk and/or shape the x-rays from the respective targets in a known manner. It is noted that while FIGS. 8*a* and 8*b* illustrate the use of a single x-ray window, two or more separate, spaced apart windows can be used instead, one window per target or for a subset of two or more targets, and the number of targets can be more or less than four. The tube illustrated in FIGS. 8*a* and 8*b* can be operated by simultaneously energizing all targets or any desired subset of the targets, or by energizing the targets in any desired sequence or pattern.

It should be clear that the invention is applicable to multifaceted x-ray tubes which have more than four faces at the front end of the target support and more than four targets. For example, a tube in accordance with the invention can have 5, 6, 7, 8, . . . facets at the target support front end and an equal or lesser number of targets. The targets can be all of different materials or some targets may be made of the same material. The facets can be symmetrically or asymmetrically arranged relative to the target support axis, and can be the same or different in size. The geometry can be changed such that some or all of the x-ray beams are not parallel to each other and the directions of any one or more beams either converge or diverge relative to the directions of other beams, for example by changing the relative orientation of facets and the positions of the internal collimators and the windows. The electron guns can be as described above, where each filament is centered on its target and the electron beam impinges substantially on the entire target, in a pattern determined primarily by the geometry of the gun and the target, by their relative positions and by the potential between the target and the gun. In the alternative, additional fields can be used in a known manner to focus one or more of the electron beams on their respective targets, as with plates 52 and focusing field potential sources E(f) schematically illustrated for the electrons from filament 18*a* in FIG. 3. While filaments have been discussed as electron sources, any other suitable hot or cold cathodes can be used. While one use of the invented x-ray tube is in x-ray fluorescence spectrometers, the tube can be used in other environments as well, such as, without limitation, for thickness gauging by use of x-ray transmission measurements, for process control and material specification control, for radiography or densitometry, and as an isotope replacement. As will be appreciated by those skilled in the art, many other variations are possible within the scope of the invention.

I claim:

1. A multitarget x-ray tube comprising:

a target support;

a number of targets on said target support, wherein each target has a differently oriented x-ray emitting surface and is made of a different x-ray emitting material;

an individually controlled electron gun for each of said targets, each gun emitting electrons which impinge on its target to cause x-ray emission therefrom;

a housing enclosing at least said targets and having a separate x-ray window for an x-ray beam from each of said targets.

2. A multitarget x-ray tube as in claim 1 including collimation which is inside said housing and separates said x-ray beams from each other.

3. An x-ray tube as in claim 2 in which said target support has therein channels which separate adjacent targets from each other to reduce cross-talk.

4. An x-ray tube as in claim 3 in which said target support has a multifaceted front end and each of said targets is at a respective facet of said front end, and wherein said front end has an axial depression which is deeper than said channel to further reduce cross-talk.

5. An x-ray tube as in claim 4 in which the outside edges of said channels and said axial depression are rounded to reduce cross-talk.

6. An x-ray tube as in claim 5 in which said target support is round and has a diameter of about 0.75", the axial extent of said front end is about 0.10", said channels are about 0.10" deep and wide, and said axial depression is about 0.25" deep and about 0.25 in diameter.

7. An x-ray tube as in claim 6 in which said housing is a vacuum vessel and said collimation comprises respective tubular collimators for said beams which are inside said housing and space said beams from each other inside the housing and direct them along directions substantially parallel to the axis of said target support.

8. An x-ray tube as in claim 7 including a network for individually controlling said electron guns to generate a selected pattern and/or sequence.

9. A multitarget x-ray tube as in claim 1 in which said target support has therein channels which separate adjacent targets from each other to reduce cross-talk.

10. A multitarget x-ray tube as in claim 9 in which said target support has a multifaceted front end and each of said targets is at a respective facet of said front end, and wherein said front end has an axial depression which is deeper than said channel to further reduce cross-talk.

11. An x-ray tube as in claim 10 in which the outside edges of said channels and said axial depression are rounded to reduce cross-talk.

12. A multitarget x-ray tube as in claim 1 in which said target support has a multifaceted front end and each of said targets is at a respective facet of said front end, and wherein said front end has an axial depression which separates front portions of said targets from each other to help reduce cross-talk.

13. An x-ray tube as in claim 1 in which said collimation comprises respective tubular collimators for said beams which are inside said housing and space said beams from each other inside the housing and direct them along respective beam paths.

14. An x-ray tube as in claim 1 in which the materials for said targets are selected from the group consisting of Ti, Cr. Fe, Co, Ni, Cu, Mo, Rh, Ag, Ta, W, Re, Pt and Au.

15. An x-ray tube as in claim 1 including a network for individually controlling said electron guns to generate a selected pattern and/or sequence of said x-ray beams.

16. An x-ray tube comprising:

a target support;

a number of targets on said target support, wherein each target has a differently oriented x-ray emitting surface and is made of a different x-ray emitting material;

an electron source individually controlled to selectively energize any one of said targets to thereby cause any individual target or any selected combination of targets to emit a respective beam of x-rays;

an internal collimating structure in said housing to collimate said x-ray beams from the respective targets into respective individually collimated x-ray beams.

17. An x-ray tube as in claim 16 in which said target support has therein channels which separate adjacent targets from each other to reduce cross-talk.

18. An x-ray tube as in claim 17 in which said target support has a multifaceted front end and each of said targets is at a respective facet of said front end, and wherein said front end has an axial depression which is deeper than said channel to further reduce cross-talk.

19. An x-ray tube as in claim 18 in which the outside edges of said channels and said axial depression are rounded to reduce cross-talk.

20. A method of generating a selected pattern and/or sequence of x-ray beams of different characteristics from a single x-ray tube, comprising:

providing a multifaceted target holder having a target of a different material at each facet;

energizing selected targets at selected times to cause the energized targets to emit x-rays having characteristics determined at least in part by the respective target materials; and collimating the x-rays emitted from said targets into respective separate x-ray beams.

21. A method as in claim 20 in which said collimating step comprises taking said beams outside the tube housing through separate windows.

22. A method as in claim 21 in which said collimating step further comprises collimating said beams by separate collimators inside said tube housing.

23. A multitarget x-ray tube comprising:

a target support having at least one x-ray window which has an inside surface and an outside surface;

a number of x-ray targets which are at the inside surface of said at least one x-ray window and are substantially coplanar and selectively made of different x-ray emitting materials;

an individually controlled electron beam source for each of said targets, each source emitting a respective electron beam which travels to its respective target along a direction substantially perpendicular to the plane of the target and causes the target to emit an x-ray flux which passes through the outside surface of said at least one x-ray window in a direction generally following the direction of the impinging electron beam;

a housing enclosing at least said targets and said electron sources such that said inside surface of said at least one window is inside said housing.

24. A multitarget x-ray tube as in claim 23 in which said x-ray targets are sputtered on the inside surface of said at least one x-ray window.

25. A multitarget x-ray tube as in claim 24 which has a single x-ray window and in which said targets are at the inside surface of the same single window but are spaced from each other along said inside surface.

26. A multitarget x-ray tube a in claim 25 including collimators which extend from said targets toward the interior of said housing to help reduce cross-talk between the electron beams and between the targets.

27. A multitarget x-ray tube as in claim 26 in which said collimators comprise a respective tubular collimator for each of said targets, each tubular collimator surrounding its target and extending therefrom toward the interior of said housing.

* * * * *